US006565020B1

(12) United States Patent
Fischer et al.

(10) Patent No.: US 6,565,020 B1
(45) Date of Patent: May 20, 2003

(54) ELECTROMAGNETIC ACTUATOR AND STATOR DESIGN IN A FUEL INJECTOR ASSEMBLY

(75) Inventors: W. Scott Fischer, Grandville, MI (US); Todd Helsel, Grand Rapids, MI (US); David Eickholt, Kentwood, MI (US)

(73) Assignee: Detroit Diesel Technology, Kentwood, MI (US)

( * ) Notice: Subject to any disclaimer, the term of this patent is extended or adjusted under 35 U.S.C. 154(b) by 0 days.

(21) Appl. No.: 10/197,317

(22) Filed: Jul. 16, 2002

(51) Int. Cl.[7] ..... F02M 51/00
(52) U.S. Cl. ..... 239/585.1; 239/88
(58) Field of Search ..... 239/585.1, 585.5, 239/88, 96

(56) References Cited

U.S. PATENT DOCUMENTS 4,384,681 A * 5/1983 Claxton ..... 239/585.5
4,392,612 A * 7/1983 Deckard et al. ..... 239/88
5,174,336 A * 12/1992 Casey et al. ..... 137/625.65
6,238,190 B1 5/2001 Czarnecki et al.
6,276,610 B1 8/2001 Spoolstra

FOREIGN PATENT DOCUMENTS

WO WO 02/31342 4/2002

* cited by examiner

*Primary Examiner*—Timothy L. Maust
*Assistant Examiner*—Lina R Kontos
(74) *Attorney, Agent, or Firm*—Brooks & Kushman P.C.

(57) ABSTRACT

An electromagnetic actuator for a control valve module in an engine fuel injector, the module being a replaceable, independent element of the injector. The actuator has a stator with electromagnetic coil windings on a bobbin located within the control valve module. An armature is connected to a control valve in the module. The bobbin supports and precisely positions connector pins for the coil windings for registry with an external electrical wire harness.

14 Claims, 4 Drawing Sheets

ELECTROMAGNETIC ACTUATOR AND STATOR DESIGN IN A FUEL INJECTOR ASSEMBLY

BACKGROUND OF THE INVENTION

1. Field of the Invention

The invention relates to an electromagnetic actuator for the control valve of a fuel injector for internal combustion engines.

2. Background Art

A fuel injection pump and control valve assembly of well known design is disclosed in U.S. Pat. No. 6,238,190. It comprises an injector pump body with a high pressure pump chamber that communicates with an injection nozzle and a control valve chamber located between the pump chamber and an outlet port for an injector nozzle. A plunger located in the pump chamber is actuated by a camshaft driven mechanical driver, which effects a pumping stroke of the plunger for each engine cycle of a four stroke engine cycle, each cycle corresponding to two engine revolutions.

The control valve chamber of the known design is situated in transverse disposition with respect to the direction of travel of the plunger. It occupies substantial space within the cylinder body. A separate electromagnetic actuator secured to the pump body is under the control of an electronic engine controller. The actuator strokes the control valve to define fuel pressure pulses at the nozzle as the plunger is driven through its working stroke. The control valve, which is moved by the actuator between open and closed positions, has a rate shape position disposed between the open position of the valve and the closed position.

Co-pending patent application Ser. No. 10/208,587, entitled "Fuel Injector For Diesel Engines," filed by W. Scott Fischer, David Eickholt, and Mike Weston on Jul. 30, 2002 (Attorney Docket No. DDTC 0204 PUS), discloses an injector assembly for an internal combustion engine, wherein the control valve and valve actuator are formed as a module that is independent of the pump body and the nozzle assembly, the module, the plunger body and the nozzle assembly being arranged in linear, stacked relationship with an economy of space. Assembly procedure, during high volume manufacture of the injector, is substantially simplified. The co-pending application is assigned to the assignee of the present invention.

Because of the integration of the actuator and the control valve within an independent module, it becomes necessary to provide a connector mechanism for the electromagnetic actuator for the control valve that can be readily detached as a separate component. The actuator also must be designed to minimize the area occupied by the actuator within the module itself while accommodating a secure electrical connection for actuator coil windings as the module is assembled with the pump body and the nozzle assembly. In addition, the connector mechanism must seal between internal diesel fuel under low pressure and external engine oil under no pressure.

SUMMARY OF THE INVENTION

The electromagnetic actuator of the invention is adapted for use with a control module of the kind described in the co-pending patent application previously identified. The actuator for the control valve comprises a separate subassembly as an element of the control module. The control module itself, as well as the actuator, may be replaceable components of the overall injector assembly.

The electromagnetic actuator, which is a detachable component of the module, includes connector pins that pass through, and are electrically shielded from, the pump body. An electrical connector assembly is mounted on the body of the injector assembly and is connected to an engine wiring harness. The connector pins register with electrical connectors of the connector assembly.

The electromagnetic actuator makes provision for efficient winding of the actuator coils on a bobbin to define a stator assembly that makes it possible to reduce the length of the connector pins. The stator assembly is capable of precisely locating the connector pins relative to the centerline of the plunger of the injector assembly. The pins are located by the stator so that the required space for the stator core may be reduced to a minimum.

The control module includes a fuel pressure control valve. The electronic actuator has an armature connected to the fuel pressure control valve. The centerline of the control valve extends in the direction of movement of the armature.

The stator assembly, which is adjacent the armature, has a core, an electric coil bobbin, coil windings on the bobbin, and a bobbin extension radially disposed relative to the control valve.

Electrical connector pins are secured to the bobbin extension and are connected to the coil windings. The connector pins extend in the direction of the valve centerline.

An external connector assembly is secured to the body of the fuel pumping cylinder. The connector has electrical conductors that establish a connection to a wire harness for an engine controller. The pins register with the electrical conductors as the control module is assembled in place adjacent the fuel pumping chamber body.

The bobbin radially positions the connector pins to effect a connection with the electrical conductors. The bobbin extension is strategically positioned to effect a reduced connector pin length and to facilitate winding of the coil windings on the bobbin.

The bobbin extension, the wire leads for the bobbin coil windings, and the adjacent ends of the pins are over-molded with an insulating and reinforcing material.

The bobbin and the coil windings are assembled within the stator core. The stator core then is assembled within the control module. The bobbin radial extension is located in an opening in the stator core.

DETAILED DESCRIPTION OF THE PREFERRED EMBODIMENT

Figure 1:
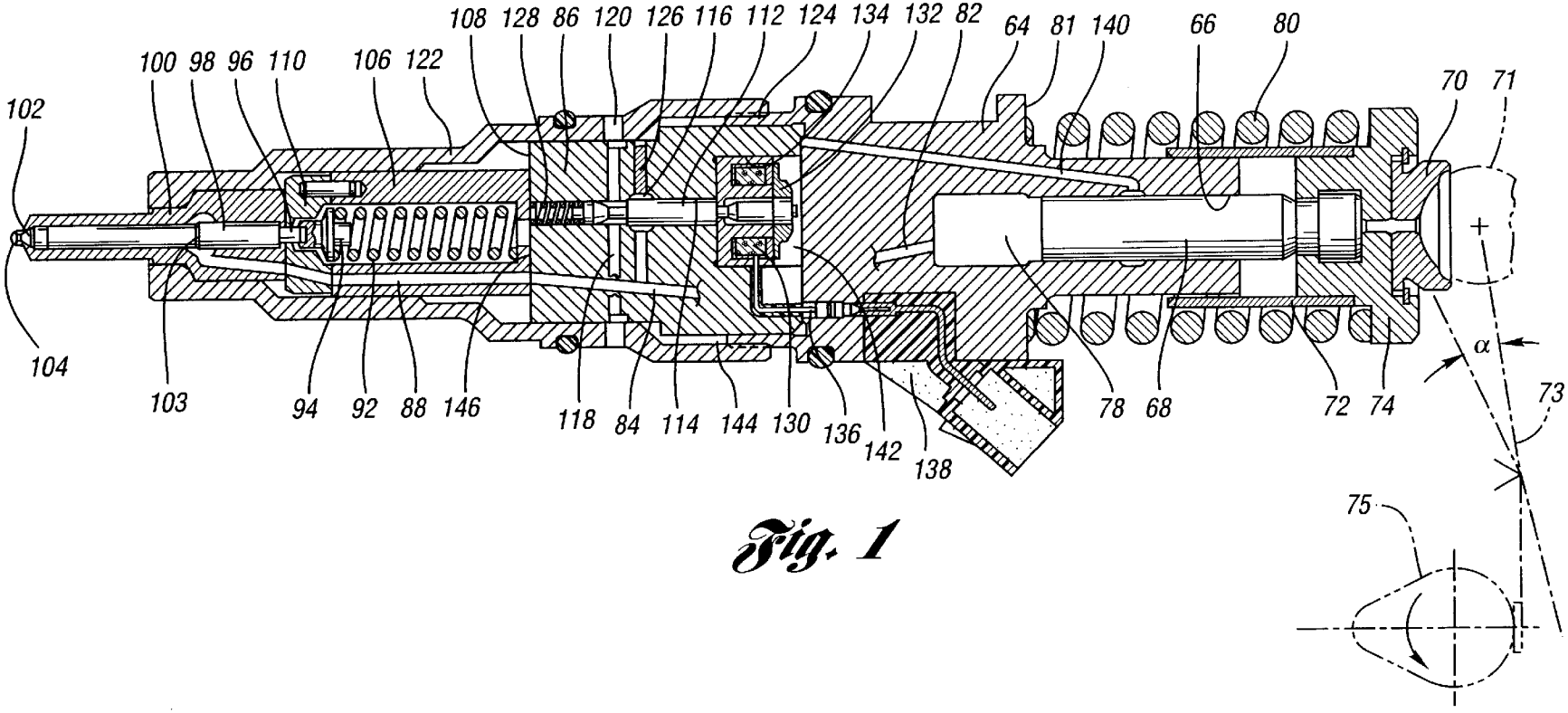
FIG. 1 is a cross-sectional view showing the overall assembly of an injector that incorporates the electromagnetic actuator of the invention.

The injector assembly of the present invention includes a relatively small pump body 64. A central pumping cylinder 66 in body 64 receives plunger 68. A cam follower assembly 70 includes a follower sleeve 72 and a spring seat 74. The follower assembly 70 is connected to the outer end of plunger 68. The cylinder 66 and plunger 68 define a high-pressure cavity 78. The plunger is urged normally to an outward position by plunger spring 80, which is seated on the spring seat 74 at the outer end of the plunger. The inner end of the spring is seated on a spring seat shoulder 81 of the pump body 64.

The cam follower 70 is engageable with a surface 71 of an actuator assembly shown at 73, which is driven by engine camshaft 75 in known fashion. Plunger 68 is driven at a stroke frequency directly related to engine speed, as previously explained. The stroking of the piston creates pumping pressure in chamber 78, which is distributed through an internal passage 82 formed in the lower end of the body 64. This passage communicates with the high-pressure passage 84 formed in the control valve module 86. The opposite end of the passage 84 communicates with high-pressure passage 88 in a spring cage 106 for needle valve spring 92.

When the actuator assembly 73 moves through an angle $\alpha$, there will be a tendency for a transverse load to develop on follower 70. To avoid that transverse load, follower 70 is provided with transverse freedom of movement relative to seat 74 as relative sliding movement at the engaging surfaces of the follower and the seat takes place. Transverse load also may be transmitted from seat 74 to sleeve 72, which is supported by cylinder body 64, reducing transverse load transmitted to plunger 68.

The dimensional tolerances of the plunger 68 and the cylinder 66 provide a fit that is much closer than the fit of sleeve 72 on the body 64. To accommodate the differences in the tolerances for plunger 68 and for the sleeve 72, provision is made for relative sliding movement at the engaging surfaces of the plunger 68 and the seat 74. Thus, there are four locations for compliant shifting movement of the elements of the plunger and actuator mechanism. The first is the spherical interface between the engine rocker arm 71 and the follower 70. The second location is the flat surface at the interface of follower 70 and seat 74. The third location is at the cylindrical surface interface of the sleeve 72 and the portion of body 64 over which the sleeve 72 fits. The fourth location is at the interface of the plunger 68 and the seat 74.

The spring 92 engages a spring seat 94, which is in contact with the end 96 of a needle valve 98 received in a nozzle element 100. The needle valve 98 has a large diameter portion and a smaller diameter portion, which define a differential area 103 in communication with high-pressure fluid in passage 88. The end of the needle valve 98 is tapered, as shown at 102, the tapered end registering with a nozzle orifice 104 through which fuel is injected into the combustion chamber of the engine with which the injector is used.

When the plunger 68 is stroked, pressure is developed in passage 88, which acts on the differential area of the needle valve and retracts the needle valve against the opposing force of needle valve spring 92, thereby allowing high-pressure fluid to be injected through the nozzle orifice. Spring 92, located in the spring cage 106, is situated in engagement with the end of the pocket in the spring cage occupied by spring 92. A spacer 110, located at the lower end of the spring cage 106, positions the spring cage with respect to the nozzle element 100. A locator pin can be used, as shown in FIG. 1, to provide correct angular disposition of the spacer 110 with respect to the spring cage 106.

Figure 2:
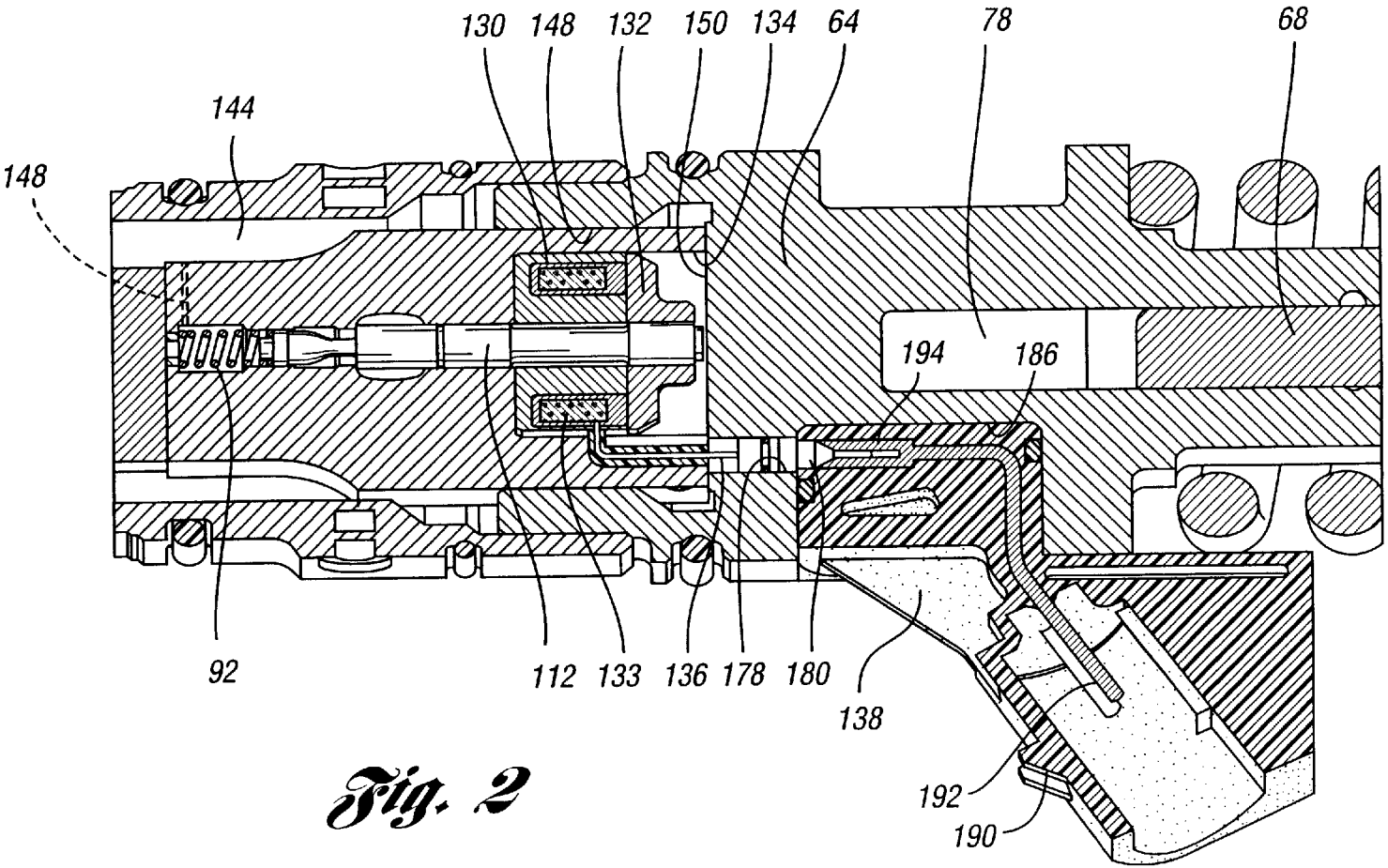
FIG. 2 is an enlarged partial cross-sectional view showing the stator design and connector pin assembly of the invention.
Figure 5:
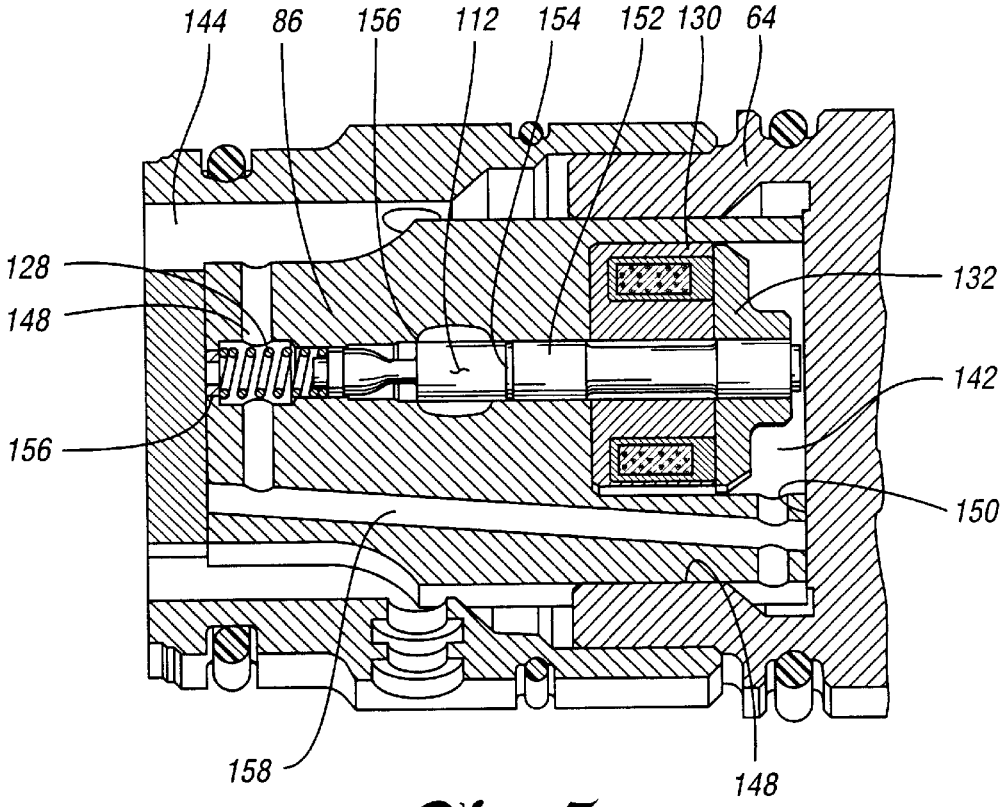
FIG. 5 is a partial cross-sectional view of the control module of the assembly of FIG. 1, taken on a plane offset from the plane of FIGS. 1 and 2.

A control valve 112 is located in a cylindrical valve chamber 114. A high-pressure groove 116 surrounding the valve 112 is in communication with high-pressure passage 84. When the valve is positioned as shown in FIGS. 2 and 5, the valve 112 will block communication between high-pressure passage 84 and low-pressure passage or spill bore 118, which extends to low-pressure port 120 in the nozzle nut 122.

The nozzle nut 122 extends over the module 86. It is threadably connected at 124 to the lower end of the cylinder body 64.

The connection between passage 84 and groove 116 can be formed by a cross-passage drilled through the module 86. One end of the cross-passage is blocked by a pin or plug 126.

The end of control valve 112 engages a control valve spring 128 located in module 86. This spring tends to open the valve and to establish communication between high-pressure passage 84 and low-pressure passage 118, thereby decreasing the pressure acting on the nozzle valve element.

A valve 112 carries an armature 132, which is drawn toward the stator 130 when the windings of the stator are energized, thereby shifting the valve 112 to a closed position and allowing the plunger 68 to develop a pressure pulse that actuates the nozzle valve element.

The stator assembly 130 is located in a cylindrical opening 134 in the module 86. The valve 112 extends through a central opening in the stator assembly. The windings of the stator assembly extend to an electrical terminal 136, which in turn is connected to an electrical connector assembly 138 secured to the pump body 64. This establishes an electrical connection between a wiring harness for an engine controller (not shown) and the stator windings.

A low-pressure passage 140 is formed in the cylinder body 64. This communicates with a low-pressure region 142 at the stator assembly and with a low-pressure region 144, which surrounds the module 86. Fluid that leaks past the plunger 68 during the pumping stroke is drained back through the low-pressure passage 140 to the low-pressure return port 120.

The interface of the upper end of the spring cage 106 and the lower end of the module 86 is shown at 146. The mating surfaces at the interface 146 are precisely machined to provide flatness that will establish high-pressure fluid communication between passage 88 and passage 84. The pressure in spring cage 106, however, is at the same pressure that exists in port 120. This is due to the balance pressure port 148, seen in FIG. 5, whereby the chamber for spring 128 communicates with the low-pressure region surrounding the module 86.

The interface between the upper end of the module 86 and the lower end of the pump body 64 is shown in FIG. 2. The upper surface of the module 86 and the lower surface of the pump body 64 are precisely machined to establish high-pressure fluid distribution from passage 82 to passage 84. The seal established by the mating precision machined surfaces at each end of the module 86 eliminates the need for providing fluid seals, such as O-rings.

The assembly of the pump body 64, the module 84, the spring cage 106 and the nozzle element 100 are held in stacked, assembled relationship as the nozzle nut 122 is tightened at the threaded connection 124. The module, the spring cage and the nozzle element can be disassembled readily merely by disengaging the threaded connection at 124, which facilitates servicing and replacement of the elements of the assembly.

As seen in FIG. 5, the valve includes a valve guide portion 152, which is formed with a pressure equalization groove 154 to prevent a pressure differential across the valve that might cause valve friction. The left end of the valve, shown in FIG. 5, is biased by spring 128, which is seated at 156.

A balance pressure passage 158, seen in FIG. 5, extends in a generally axial direction through the module 86 so that the cavity occupied by the armature, shown in FIG. 1 at 142, and the chamber for spring 128 are balanced with the same low pressure that exists in region 144'.

The windings 133 of the stator assembly 130 encircle a bobbin 160. The windings 133 are wound about the bobbin 160 with a winding machine, the edges of the windings being defined by flanges 162 and 164 of the bobbin. The flange 162 extends transversely with respect to the axis of the bobbin, as shown at 166. The connector pins 136, 136' are assembled in a fixed fashion in openings formed in the end piece or riser 168 for the extension 166. One end of the windings 133 is received in a groove 170 on one side of the extension 166. The end of the windings 133 located in the groove 170 are connected electrically to the pin 136', as shown by the windings at 172. In a similar fashion, the other end of the windings 133 is received in a groove on the opposite side of the extension 166 and connected by windings 176 to pin 136. It is trained through a groove 174 in the riser 168 and is electrically connected to connector pin 136, as shown at 176.

Figure 3:
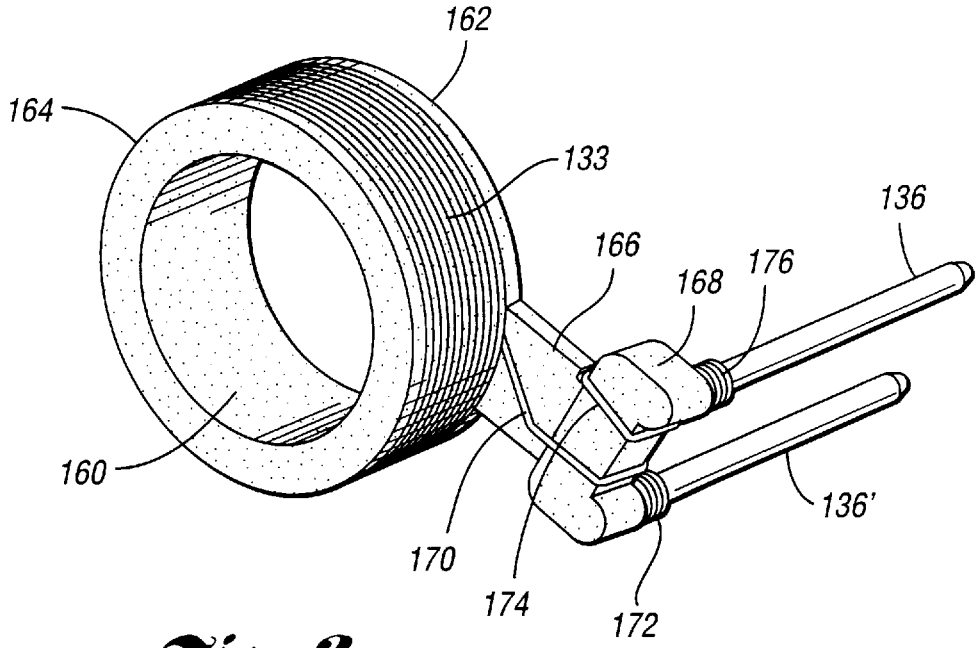
FIG. 3 is a detail isometric subassembly view of a bobbin with electromagnetic coil windings and connector pins for use in the assembly of FIG. 4.

The flange 162 extends radially outward, as shown in FIG. 3. This provides a clear open area for winding the bobbin without interference with the connector pins. The extension 166 is located at the top of the module body so the lengths of the pins 136 and 136' can be shortened as much as possible. The pins extend axially and are precisely maintained in position by the bobbin so that they are easily received in the connector assembly 138. An electrical connection is established between the pins 136 and 136' and a conductor terminal 194 during assembly of the control module within the opening 148 at the lower end of the body 64. The bobbin thus can set the precise location of the connector pins relative to the centerline of the valve chamber 114. The extension terminal 168 provides for maximum spacing between the pins 136 and 136', which facilitates the placement of windings 172 and 176.

Figure 4:
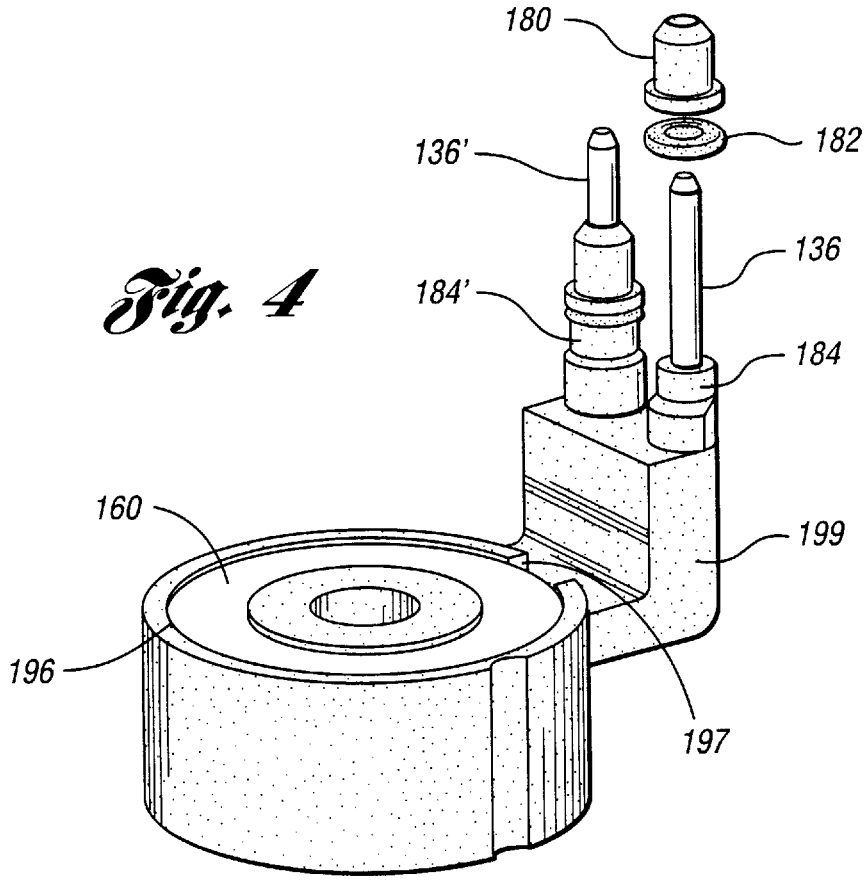
FIG. 4 is an isometric view of the bobbin and pin arrangement of FIG. 3 over-molded to a magnetic core to form a stator assembly.

The bobbin, coil windings and pins of FIG. 3 form an assembly, which is then placed in the magnetic core 196, as seen in FIG. 4. The windings 172 and 176 and the pins 136 and 136' are located radially outward with respect to the core. The bobbin extension 166 passes through an opening 197 in the core. Pins 136 and 136' are secured in place in extension terminal 168. The components are then secured together by an over-mold of insulator material. The over-mold serves as a structural reinforcement as well as an electrical insulator. The over-mold forms the reinforced riser 199, which encases wire leads in grooves 170 and 174, which are connected to pins 136 and 136'. It also forms features 184 and 184'. The wide spacing of the pins facilitates the over-molding process.

The core opening 197 can be made of minimal width, thereby making it possible for the core material to have a maximum circular dimension to improve magnetic flux density.

The stator assembly of FIG. 3 is secured in the cavity 134 of the module body, as seen in FIG. 1. The stator assembly is removable and thus forms an interchangeable component of the module.

As seen in FIGS. 2 and 4, features 184 and 184' of the stator assembly 130 and the connector pins 136 and 136' extend through openings 178 in the body 64. Electrical insulators 180 surround the pins 136 and 136' and properly locate them. The insulators 180, which may be formed of nylon or some similar material, are situated directly adjacent O-ring seals 182, which surround pins 136 and 136'. The seals are located, when assembled, between the insulators 180 and the lower surface of body 64.

The connector assembly 138 may be formed of a moldable insulating material. As best seen in FIG. 2, it is secured during assembly in a recess 186 in the body 64.

The connector assembly 138 is configured, as shown at 190 in FIG. 2, to accommodate an electrical cable connection with an engine control module, not shown. The connector assembly 138 includes the conductor 192 molded in the body of the connector assembly 138. The conductor terminal 194 at the inward end of connector 192 receives the end of the pin 136. A corresponding conductor terminal in the connector assembly 138 receives the companion connector pin 136'.

The drawings show connector pins that are inserted in the conductor terminals, but the conductor terminals and the connector pins could readily be arranged so that the former are inserted in the latter. In either case, an electrical connection is established.

Although an embodiment of the invention has been disclosed, it will be apparent to persons skilled in the art that modifications may be made without departing from the scope of the invention. All such modifications and equivalents thereof are intended to be covered by the following claims.

What is claimed is:

1. An electromagnetic actuator for a fluid pressure control valve in a fuel injector for an internal combustion engine, the injector having a control module subassembly, a pump body defining a fuel pumping cylinder, an engine driven plunger in the cylinder, a fuel nozzle assembly comprising a nozzle control valve spring and spring cage subassembly, the module subassembly being disposed between the spring cage subassembly and the pump body;

the control module subassembly including a fuel pressure control valve, the electromagnetic actuator having an armature connected to the fuel pressure control valve, the control valve having a centerline extending in the direction of movement of the armature;

a stator assembly adjacent to the armature including an electric coil bobbin, coil windings supported on the bobbin, the bobbin having an extension disposed radially outward relative to the control valve;

electrical connector pins secured to the bobbin extension and connected to wire leads at ends of the coil windings, the connector pins extending in the direction of the centerline and into the pump body; and an external connector assembly secured to the pump body comprising electrical conductors for establishing a connection with an engine controller, the connector assembly establishing an electrical connection between the pins and the electrical conductors as the control module subassembly is assembled in place adjacent to the pump body.

2. The electromagnetic actuator set forth in claim 1 wherein wire leads at the ends of the coil windings are trained over the bobbin extension at a side of the bobbin directly adjacent the armature, the bobbin being disposed within the control module subassembly and the armature being disposed between the bobbin and the pump body.

3. The electromagnetic actuator set forth in claim 1 wherein the bobbin extension maintains the connector pins at a radial position relative to the control valve centerline to establish registry of the connector pins with respect to the electrical conductors in the connector assembly.

4. The electromagnetic actuator set forth in claim 1 wherein the pump body is provided with a recess, the connector assembly being secured in the recess with the electrical conductors aligned with the connector pins on the bobbin extension whereby the connector pins and the electrical conductors are electrically connected as the fuel injector is assembled with the pump body, the control module subassembly and the fuel nozzle subassembly in stacked, abutting relationship.

5. The electromagnetic actuator set forth in claim 2 wherein the coil windings may be wound on the bobbin without interference with the connector pins and the length of the pins may be a minimum.

6. The electromagnetic actuator set forth in claim 2 wherein the pump body is provided with a recess, the connector assembly being secured in the recess with the electrical conductors aligned with the connector pins on the bobbin extension whereby the connector pins and the electrical conductors are electrically connected as the fuel injector is assembled with the pump body, the control module subassembly and the fuel nozzle subassembly in stacked, abutting relationship.

7. The electromagnetic actuator set forth in claim 1 wherein the bobbin, the coil windings and the bobbin extension are encased in an electrical insulator over-mold, the over-mold forming a reinforced riser from which the connector pins extend.

8. The electromagnetic actuator set forth in claim 2 wherein the extension is located at a side of the bobbin directly adjacent the armature, whereby the pins are of reduced length while establishing an electrical connection with the electrical conductors in the connector assembly.

9. The electromagnetic actuator set forth in claim 7 wherein the stator assembly comprises an electromagnetic core within the bobbin, a radial opening in the core, the radial extension being positioned in the radial opening, the over-mold providing a reinforced subassembly of the bobbin, the extension and the pins.

10. The electromagnetic actuator set forth in claim 9 wherein the stator assembly, including the pins, define a component of the control module subassembly, which is separable from the actuator and interchangeable with a replacement stator assembly.

11. The electromagnetic actuator set forth in claim 9 wherein the radial opening in the core is of a reduced size to provide increased magnetic flux density.

12. The electromagnetic actuator set forth in claim 1 wherein the stator assembly includes a stator core, the electric coil bobbin being received in the stator core, the stator core being received in the control module subassembly.

13. The electromagnetic actuator set forth in claim 12 wherein the stator core has an opening in which the bobbin extension is positioned.

14. The electromagnetic actuator set forth in claim 13 wherein the opening in the stator core is sized to provide for a minimum reduction of core material to effect maximum flux density.

* * * * *

UNITED STATES PATENT AND TRADEMARK OFFICE

CERTIFICATE OF CORRECTION

PATENT NO. : 6,565,020 B1
DATED : May 20, 2003
INVENTOR(S) : W. Scott Fischer et al.

It is certified that error appears in the above-identified patent and that said Letters Patent is hereby corrected as shown below:

Title page,
Item [73], Assignee, should read -- [73] Assignee: Diesel Technology Company --

Signed and Sealed this

Eighth Day of February, 2005

JON W. DUDAS
*Director of the United States Patent and Trademark Office*